US008424689B2

(12) United States Patent
McConnell et al.

(10) Patent No.: US 8,424,689 B2
(45) Date of Patent: Apr. 23, 2013

(54) MODULAR RACK SYSTEM

(75) Inventors: Bryan McConnell, Alpharetta, GA (US); Lucille Levitt, Duluth, GA (US); Robert Daniel, II, Asbury, NJ (US)

(73) Assignee: Novartis AG, Basel (CH)

( * ) Notice: Subject to any disclaimer, the term of this patent is extended or adjusted under 35 U.S.C. 154(b) by 569 days.

(21) Appl. No.: 12/639,057

(22) Filed: Dec. 16, 2009

(65) Prior Publication Data

US 2010/0155347 A1 Jun. 24, 2010

Related U.S. Application Data

(60) Provisional application No. 61/139,076, filed on Dec. 19, 2008.

(51) Int. Cl.
*A47F 7/00* (2006.01)

(52) U.S. Cl.
USPC ..... 211/13.1; 211/188; 211/194; 206/5.1

(58) Field of Classification Search ..... 211/49.1, 211/85.8, 13.1, 126.15, 126.2, 126.6, 189, 211/188, 194, 59.2, 59.4; 206/5.1; 81/488, 81/436, 438; 312/263, 107, 111, 257.1, 265.5, 312/902; 280/33.991, 33.992, 33.993, 47.18, 280/79.2
See application file for complete search history.

(56) References Cited

U.S. PATENT DOCUMENTS

| | | | | |
|---|---|---|---|---|
| 2,121,190 | A * | 6/1938 | Fellowes | 312/108 |
| 3,778,863 | A * | 12/1973 | Westergren et al. | 15/323 |
| D323,082 | S * | 1/1992 | Rones | D6/446 |
| 5,147,120 | A * | 9/1992 | Ray | 312/111 |
| 5,431,576 | A * | 7/1995 | Matthews | 439/247 |
| 5,788,347 | A * | 8/1998 | Rabinovitz | 312/111 |
| 6,334,540 | B1 | 1/2002 | Plutsky | |
| 6,488,346 | B2 * | 12/2002 | Chen | 312/263 |
| 6,640,995 | B2 | 11/2003 | Jepson | |
| 7,134,673 | B2 | 11/2006 | Ferraro | |
| 7,374,052 | B2 | 5/2008 | Price | |
| 7,963,408 | B2 * | 6/2011 | Glover | 211/126.15 |
| 2006/0131322 | A1 * | 6/2006 | Pesenti Barili et al. | 221/85 |
| 2006/0260957 | A1 * | 11/2006 | Hamilton | 206/5.1 |
| 2010/0096344 | A1 * | 4/2010 | Vanderhoek et al. | 211/49.1 |

FOREIGN PATENT DOCUMENTS

| | | | |
|---|---|---|---|
| DE | 203 08 027 | U1 | 11/2003 |
| FR | 2 654 602 | A1 | 5/1991 |
| GB | 2 132 075 | A | 7/1984 |
| GB | 2 205 225 | A | 12/1988 |
| GB | 2 335 777 | A | 9/1999 |
| GB | 2 423 464 | A | 8/2006 |
| GB | 2 440 112 | A | 1/2008 |

* cited by examiner

*Primary Examiner* — Korie H. Chan
(74) *Attorney, Agent, or Firm* — Robert Ambrose

(57) ABSTRACT

A modular racking system for storing, displaying and dispensing optical contact lenses. The system includes a reconfigurable, vertically-stacked array of modules. Each module is assembled from standard panels and includes a number of tray positions. Removable trays are slidably mounted in the modules, are vertically repositionable within the modules, and are provided in differing product configurations for different types of products or packaging. A contact lens dispensing matrix is defined by various positional indicia within the racking system, to designate various contact lens characteristics.

13 Claims, 9 Drawing Sheets

MODULAR RACK SYSTEM

This application claims the benefits under 35 U.S.C. 119(e) of the U.S. Provisional Patent Application No. 61/139,076 filed on Dec. 19, 2008, incorporated herein by reference in its entirety.

FIELD OF THE INVENTION

The present invention relates generally to systems and methods for storing, displaying and/or dispensing items; and more particularly to a universal and reconfigurable modular racking system and method for contact lenses.

BACKGROUND OF THE INVENTION

In the past, modular racks have been used as storage spaces for various items such as office supplies, papers, computers, printers, keyboards, stationary, and other personal and business items. However, many previously known racks were often bulky, cumbersome, difficult to move, and difficult to assemble, disassemble, or reconfigure. In addition, such racks were generally specific for one task (i.e. storage or transporting items) and limited to racking items of one particular size or dimension.

Thus it can be seen that needs exist for an improved racking system and method. It is to the provision of an improved racking system and method meeting these and other needs that the present invention is primarily directed.

SUMMARY OF THE INVENTION

The present invention provides a multi-functional modular rack which is easily assembled and disassembled via an interlocking attachment system. In addition, this modular rack can be used for multiple tasks such as storage, transporting items, or displaying items, and it is readily adaptable to use with items of differing sizes, and can be adjusted in overall size to more precisely fit the intended application.

In example forms, the modular racking system of the present invention includes a support base, interlocking vertically stackable modules carried on the base, and an interlocking top mounted to the uppermost module. Each stackable module optionally includes one or more slidably mounted trays or drawers, which are repositionable within the module and interchangeable with trays or drawers of differing layouts, to accommodate items of different sizes and/or types. The invention also includes a method of organizing contact lenses utilizing such a modular rack system.

In one aspect, the invention is a modular racking system for contact lenses. The system includes at least one stackable module, each stackable module having at least one tray mounted therein. The system defines an optical lens matrix based on at least one lens characteristic.

In another aspect, the invention is a modular racking system for contact lenses, the system including a support base having a plurality of removable caster wheels for conversion between movable use with the caster wheels and stationary use without the caster wheels, and defining a chamber therein for receiving a disassembly tool, the disassembly tool and the chamber desirably having closely matching shapes. The system further includes a plurality of stackable modules arranged in a vertical array, each stackable module defining a plurality of tracks for receiving vertically repositionable product trays therein, the vertically repositionable product trays sliding horizontally in and out of the stackable module, wherein the plurality of stackable modules comprises a lowermost stackable module that is releasably coupled to the support base and an uppermost stackable module above the lowermost stackable module. Each of the stackable modules includes a back panel, and left and right side panels releasably coupled to the back panel. The vertically repositionable product trays define product positions arranged in a plurality of rows and a plurality of columns. The rows are labeled with first indicia designating a first contact lens characteristic, and the columns are labeled with second indicia designating a second contact lens characteristic. The system also includes a cap releasably coupled to the uppermost stackable module. The system also includes a disassembly tool receivable within the tool-receiving chamber for releasing the coupling between the back panel and the side panels, and for releasing the coupling between the cap and the uppermost stackable module. The disassembly tool includes a handle and a spaced pair of release fingers.

In still another aspect, the invention is a dispensing matrix for contact lenses. The matrix includes a first contact lens characteristic having plurality of differing values, and a second contact lens characteristic that is different from the first contact lens characteristic and also has a plurality of differing values. The first contact lens characteristic is designated by a first matrix indicia, and the second contact lens characteristic is designated by a second matrix indicia different from the first matrix indicia. The first contact lens characteristic and the second contact lens characteristic are selected from: product type, brand, spherical correction, cylindrical correction, angle of astigmatism, size, color, and ocular condition to be treated. The first matrix indicia and the a second matrix indicia are selected from: module position within a system, tray position within a module, row position within a product array, and column position within a product array.

The advantages of the invention will be set forth in part in the description which follows, and in part will be understood from the description, or may be learned by practice of the disclosure herein. It is to be understood that both the foregoing general description and the following detailed description are exemplary and explanatory only and are not restrictive.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention, unless the context indicates otherwise. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about" or "approximately," it will be understood that the particular value forms another embodiment.

Various aspects of the present invention are directed to a modular rack system. Individual components of this modular rack system can be molded, injection molded, cast, pressed, machined, assembled, and/or otherwise fabricated from a structural material such as, for example, polyethylene, cross-linked polyethylene, polypropylene, polybutylene, polyvinyl chloride, polystyrene, polyethylene terephthalate, high density polyethylene, or other polymers or plastics, metals, ceramics, and/or other materials or combinations thereof.

Figure 1:
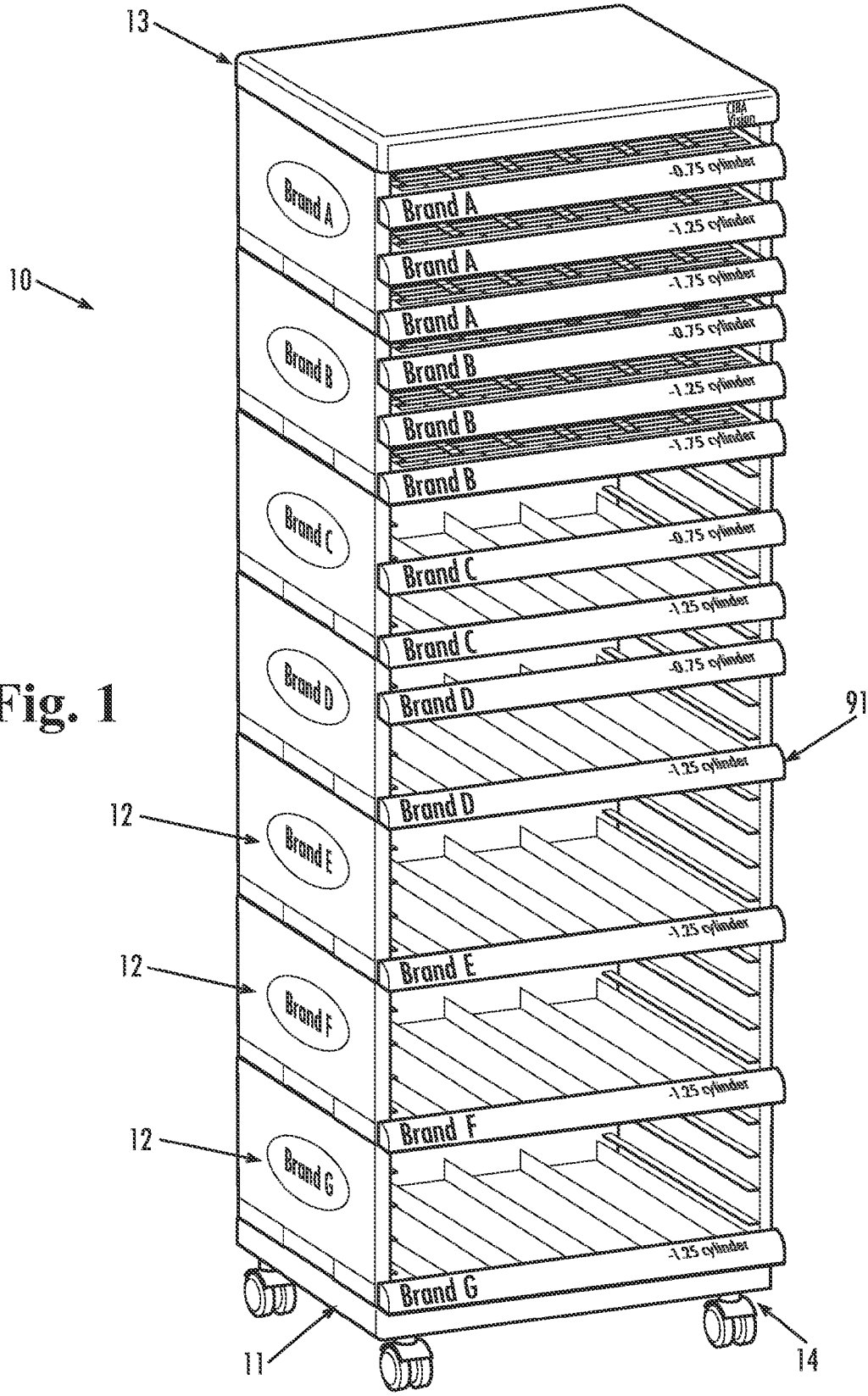
FIG. 1 shows an assembled modular rack system according to an example form of the invention.
Figure 2:
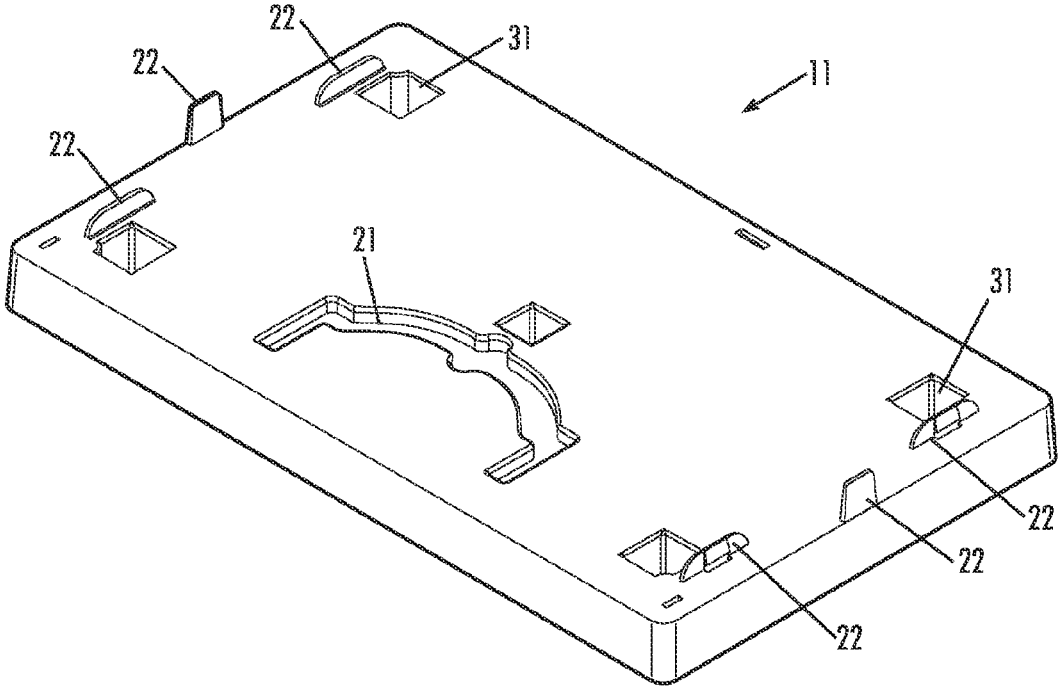
FIG. 2 is a top perspective view of the support base of the modular rack system of FIG. 1.
Figure 3:
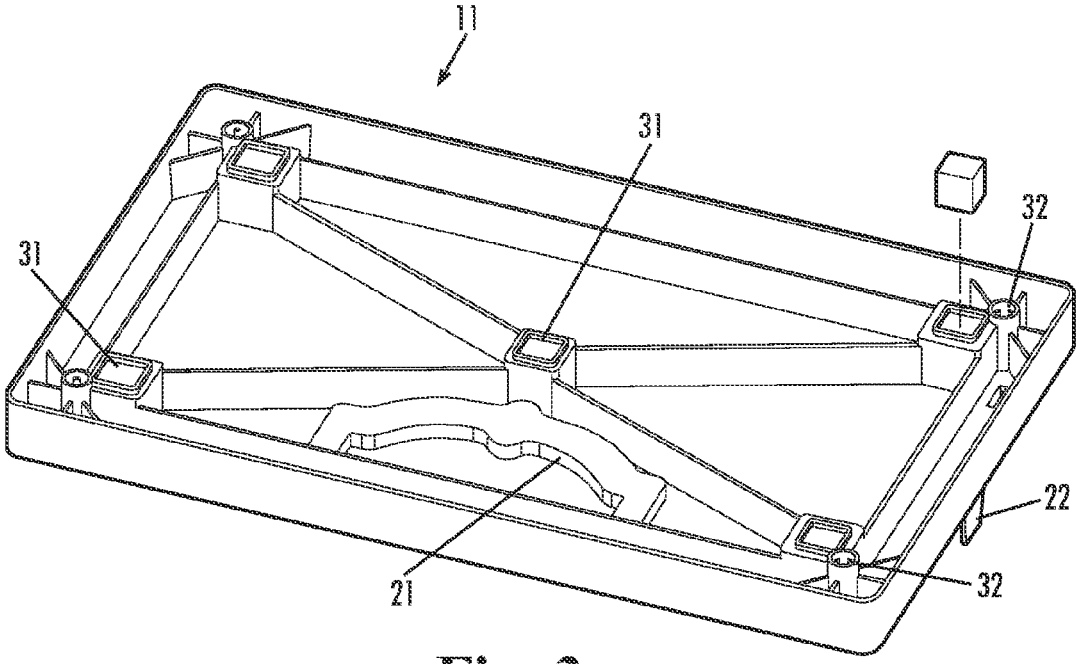
FIG. 3 is a bottom perspective view of the support base of FIG. 2.

An example embodiment of a rack system 10 is shown in FIG. 1, generally comprising a support base 11, one or more interlocking, vertically stackable modules 12, and a top 13. In alternate embodiments, the top and/or the base may be omitted or can be integrally formed as part of the one or more stackable modules. Optionally, the interlocking base 11 has caster wheels 14 attached thereto so that the modular rack platform is mobile. Alternatively, the modular rack platform is stationary and the interlocking base 11 (FIGS. 2, 3) has no wheels attached, but is provided with one or more (four are shown) supporting rubber feet 31. In a further alternative, the interlocking base 11 has rubber feet 31 and mounting sleeves 32 which allow for caster wheels to be readily attached and detached for converting the modular rack from a stationary system to a rolling system.

The interlocking base 11 comprises at least one male connector fin 22 which interlocks with at least one cooperating female receiver slot 71 of a side panel component 41 of the stackable modules to form an interlocked assembly. The base optionally defines a formed recess or chamber providing a storage compartment 21 for a disassembly tool 130. In certain aspects, the storage compartment is molded to conform to the shape of the disassembly tool 130. The disassembly tool and its manner of use will be discussed further below. Other than the storage compartment 21, the base 11 is preferably symmetrical or forms a mirror image of itself from front to back and from left side to right side about its lengthwise and widthwise medial axes, such that the modules can be assembled onto the base without regard to the orientation of the base.

Figure 4:
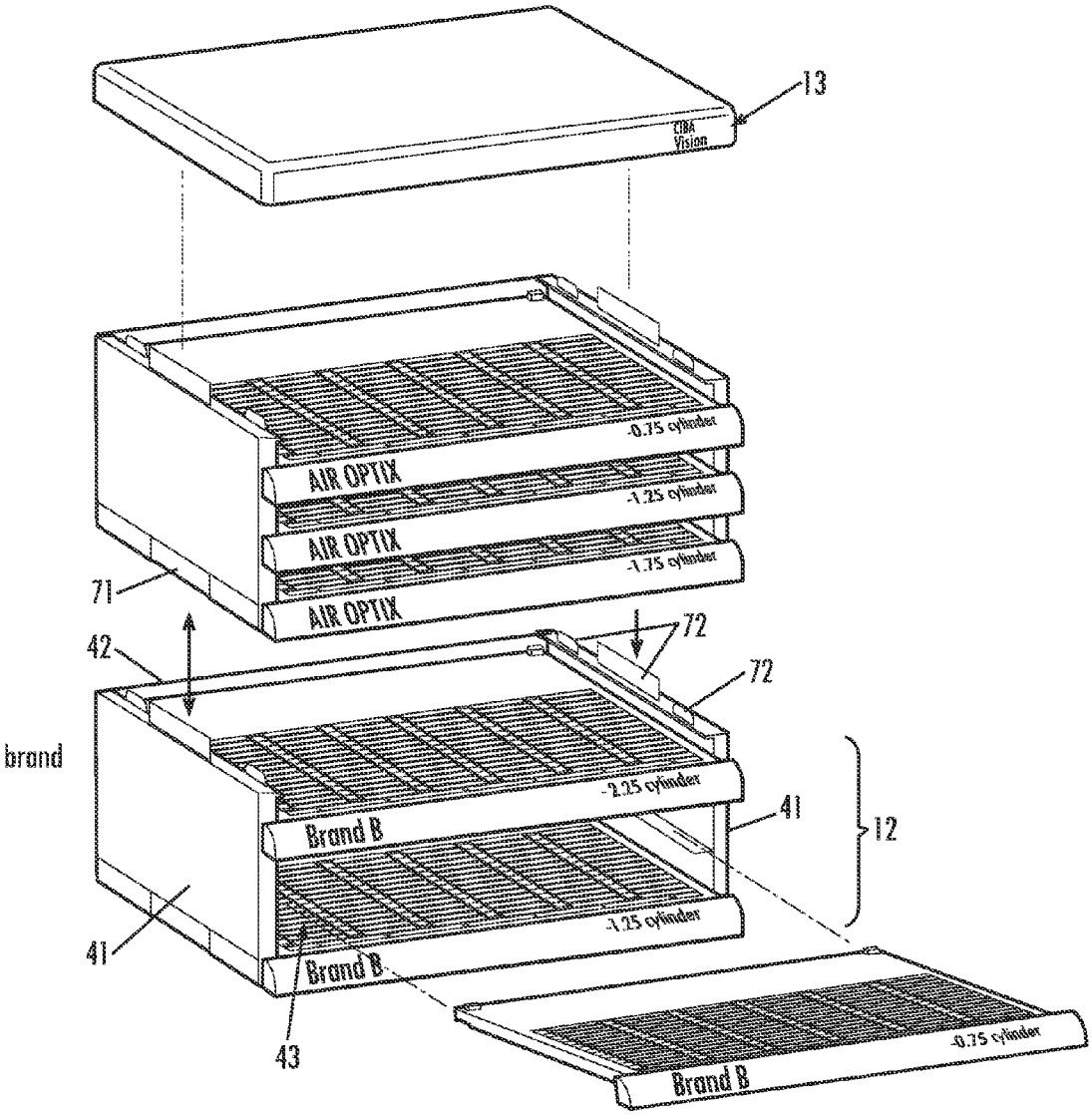
FIG. 4 is an assembly view of two vertically stackable modules and the interlocking top of the modular rack platform of FIG. 1.
Figure 5:
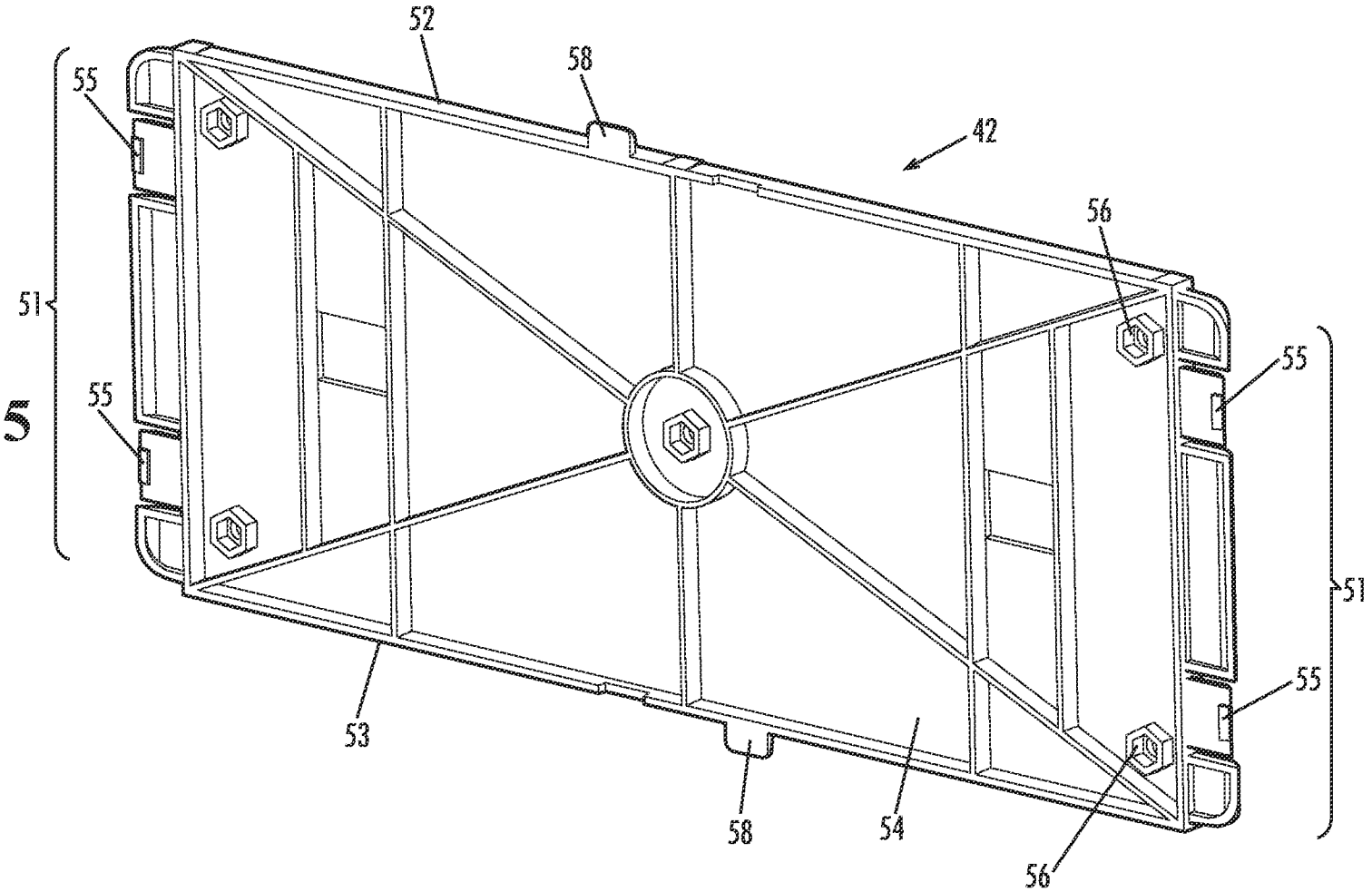
FIG. 5 is a perspective view showing the interior face of a back panel of one of the modules of the rack system, according to an example form of the invention.
Figure 6:
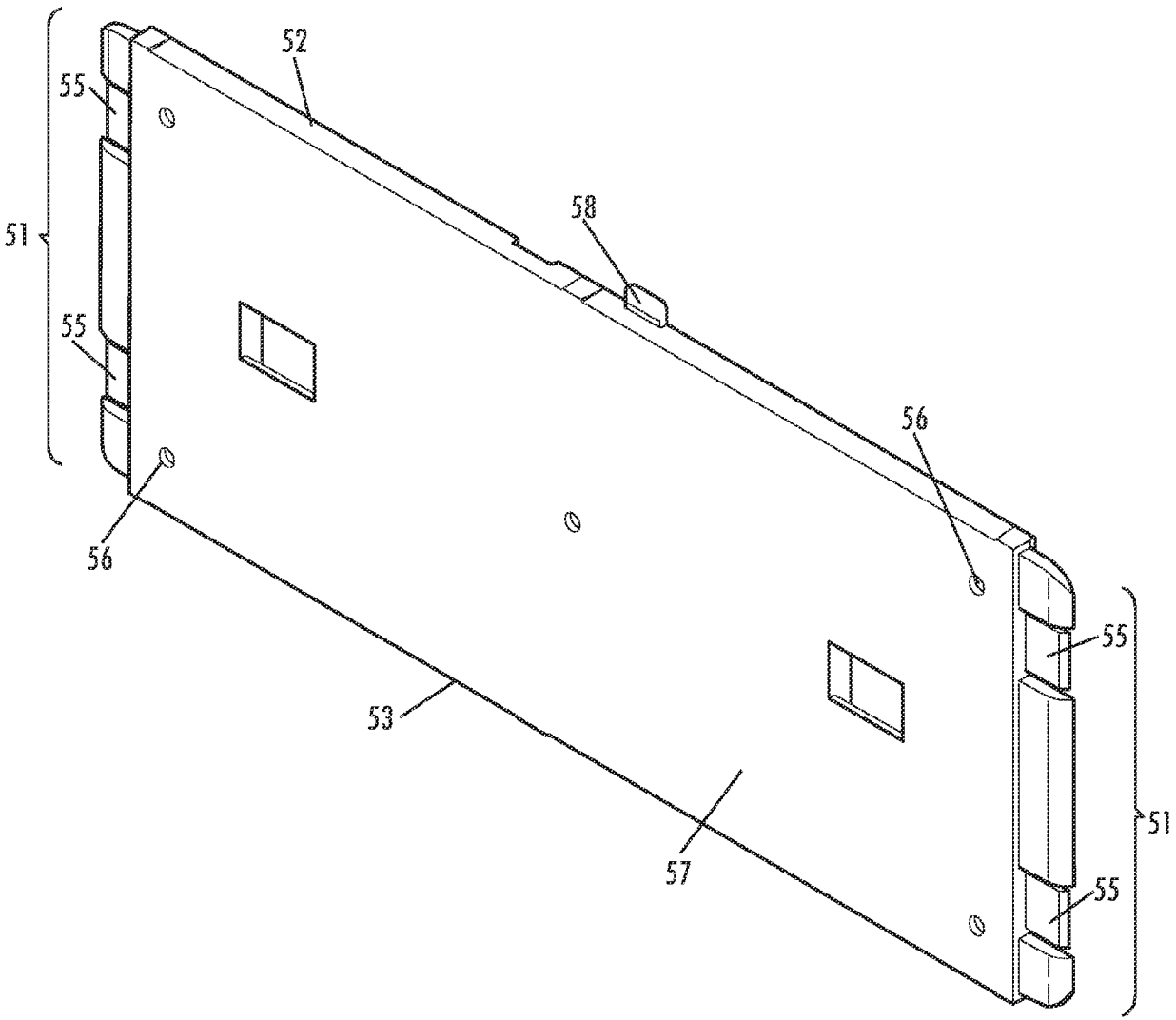
FIG. 6 is a perspective view of the exterior face of the back panel of FIG. 5.

Each interlocking, vertically stackable module 12 (FIG. 4), preferably includes two side panels 41, a back panel 42, and an open front 43. The two side panels 41 and the back panel 42 are attachable and detachable to and from one another, and are capable of being interlocked together to form the vertically stackable module 12. The back panel 42 (FIG. 5) has two sides 51, a top 52, a bottom 53, an exterior face 57 (FIG. 6), and an interior face 54. Along each of the two sides of the back section, a pair of side clips 55 project outwardly and serve to interlock the back panel 42 and the two vertical side panels 41. Additionally at least one stacking flange 58 extends from the top and the bottom of the back panel. These stacking flanges 58 serve to interlock adjacent back panels 42 of successive vertically stackable modules 12 of the modular rack system, and/or to interlock the back panel of the lowermost module to the base 11, or interlock the top 13 to the uppermost module. The back panel 41 is preferably symmetric or forms a mirror image of itself about lengthwise and widthwise medial axes, from top to bottom and from left side to right side, so that its interlocking assembly elements 55, 58 will align with and engage adjacent components regardless of the top-to-bottom or side-to-side orientation of the back panel. Optionally, as shown in FIG. 5, the interior face 54 of the back panel includes one or more mounting holes 56 for receiving fasteners such as screws, nails, hooks, or bolts to mount the racking system to a wall or other support structure.

Figure 7:
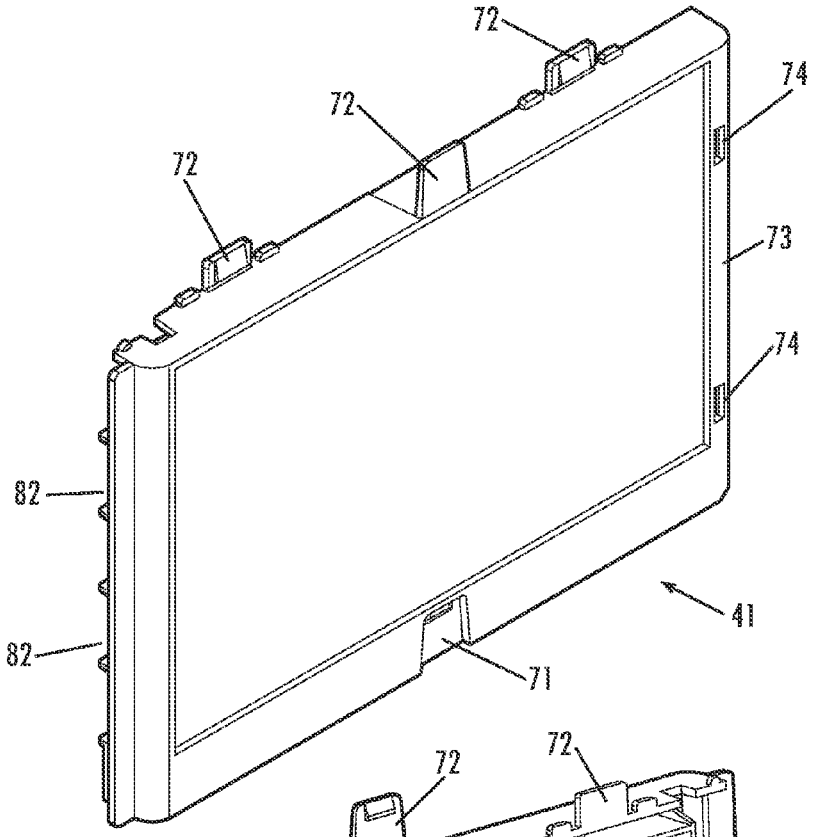
FIG. 7 is a perspective view of the exterior face of a side panel of a module of the rack system, according to an example form of the invention.
Figure 8:
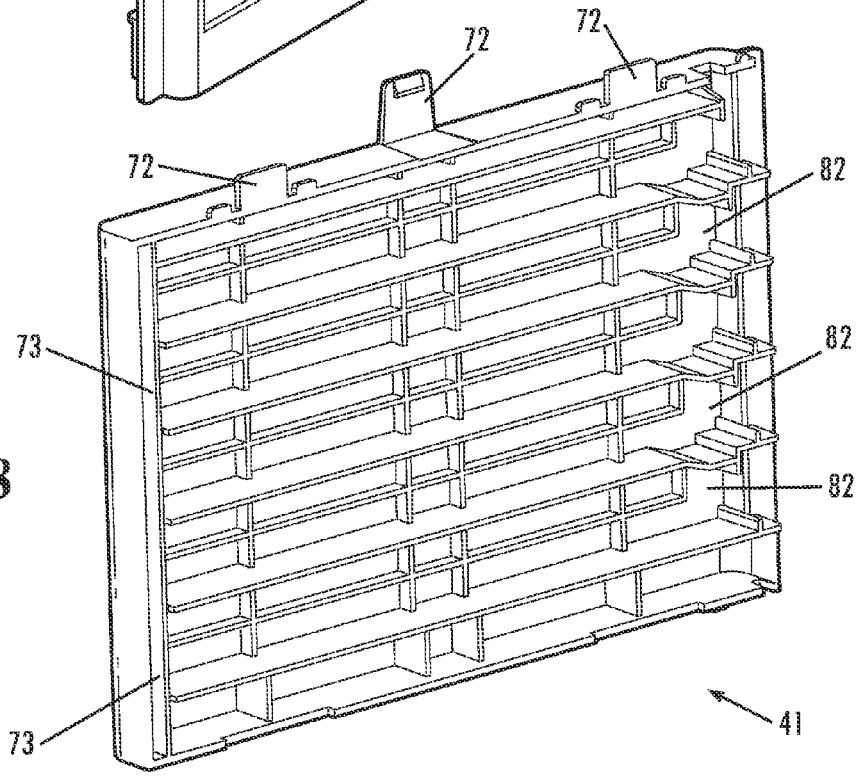
FIG. 8 is a perspective view of the interior face of the side panel of FIG. 7.

FIGS. 7 and 8 show further details of the side panel 41. Each side panel 41 has at least one female receiver or slot 71 along its lower edge and at least one male assembly flange 72 along its upper edge. In example embodiments, the side panel 41 has at least one male assembly flange projecting from the outer face of its upper edge, and at least two male assembly flanges projecting from the inner face of its upper edge; and has a corresponding at least one female receiver at the outer face of its lower edge, and at least two corresponding female receivers at the inner face of its lower edge, whereby engagement of the side panels of adjacent stacked modules prevents inward and outward lateral movement of the panels relative to one another. At least one of these cooperating pairs of interlocking assembly elements 71, 72 comprise a resilient clip or latching member, to provide a positive but releasable coupling therebetween. The female receiver slots 71 are also compatible for cooperative engagement with the connector fins 22 of the base 11, for releasable attachment of the side panels of the lowermost module 12 to the base. Each vertically stackable module 12 includes two side panels 41, a left-hand side panel and a right-hand side panel, which are substantially mirror images of one another. The interior face (FIG. 8) of each vertical side panel 41 has a vertical channel 73 extending substantially its entire height along the back edge thereof, including one or more couplings to receive and engage the engagement prongs 55 of the back panel 42, to releasably attach the left and right side panels 41 to the back panel. At least two openings 74 (FIG. 7) extend through the side panel 41 in alignment with these couplings, for disassembly using tool 130, as described herein. The interlocked back panel and two side panels thus form a single, vertically stackable module 12.

The interior face of each side panel 41 (FIG. 8) has one or more horizontal rails or tracks 82 along which a drawer or tray 91 (FIG. 9) can be slidably mounted. The number and arrangement of trays installed in each vertically stackable module 12 is variable and selectable by the user depending on what size item is to be placed inside each particular tray. For example, contact lens boxes of various dimensions can be placed inside the trays of each vertically stackable module, and the tray configuration and spacing of each module can vary depending on the type of lens. When large contact lens boxes are to be placed in a tray, that vertically stackable module may only accommodate one or two trays. However, for smaller contact lens boxes, the vertically stackable module may be able to accommodate two or more trays, for example up to six trays or more per module. In example embodiments, contact lens box dimensions to be stored in the trays can range from about 20-60 mm in height by about 10-50 mm in width and by about 30 mm-160 mm in length, but it will be understood that the invention can be adapted for use with boxes of greater or lesser dimensions. Particular box dimensions include, for example, about: 50 mm×13 mm×150 mm; 30 mm×12-13 mm×50 mm; 40 mm×40 mm×85 mm; and/or 50 mm×12-13 mm×90 mm.

The racking system 10 can include two or more vertically stackable modules 12, stacked and interlocked to one another. For example, a first vertically stackable module 12 may be stacked on top of a second vertically stackable module (FIG. 4), with the female receiver slots 71 of the first vertically stackable module interlocked with the male fins 72 of the second vertically stackable module. The top 13 and the support base 11 are interlocked to the top and bottom of the first and second vertically stackable modules, respectively. When assembled, the modular rack system 10 is preferably between 24 inches to 72 inches in height, and comprises from one to seven or more modules 12. In example embodiments, no frame structure is necessary for integrating or supporting the modules, and no connection member extends between more than two modules, thereby permitting disassembly into small, discreet and relatively flat panel components.

Figure 9:
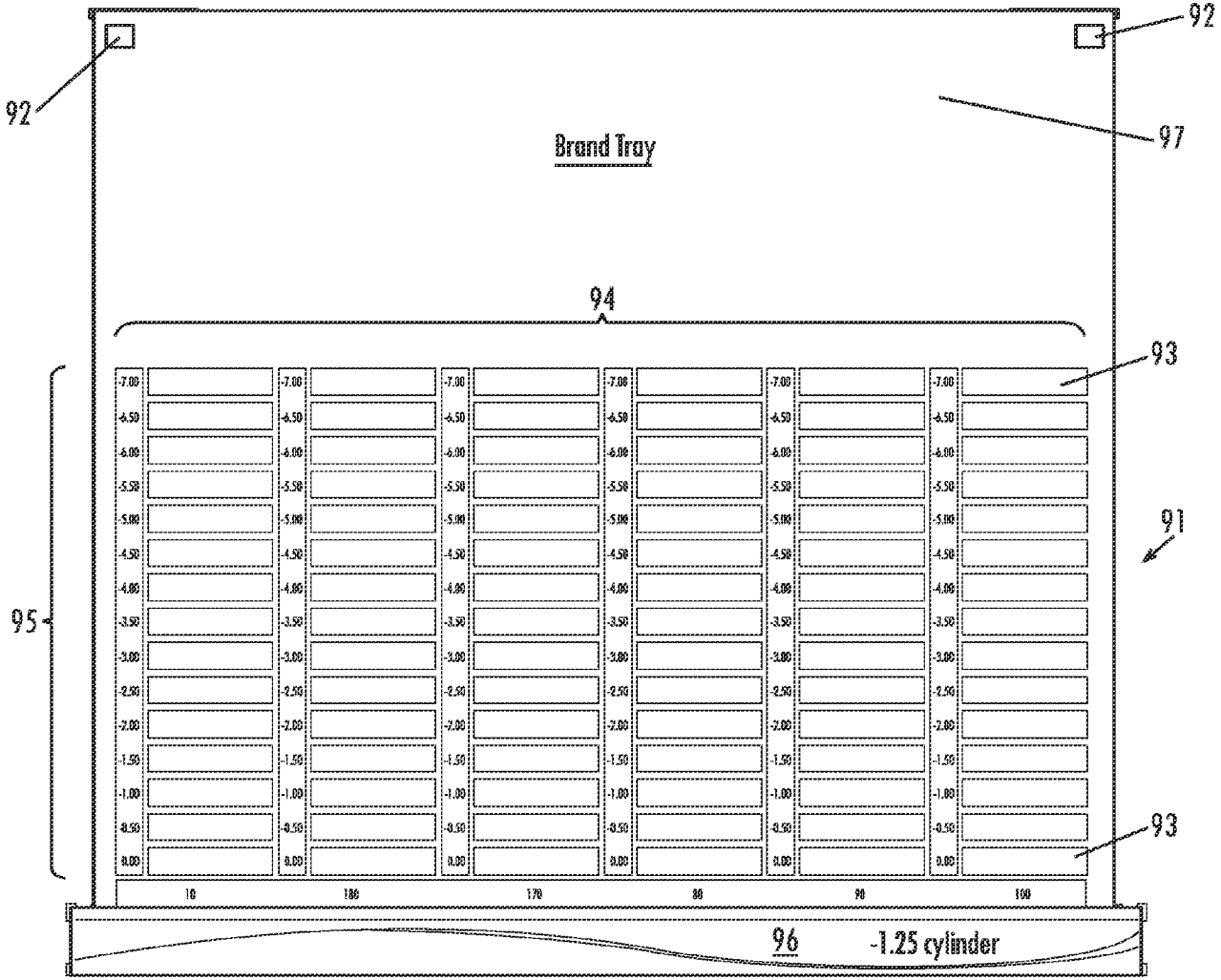
FIG. 9 is a top view of a tray component of the modular rack system, according to an example form of the invention.

The sliding drawers or trays 91 (FIG. 9) include a front portion 96 having a handle or grip member, a back portion 97, left and right sides, a top, and a bottom. Each tray slides smoothly between an open position substantially external of its respective stackable module 12 and a closed position substantially within its module. The sliding drawers or trays 91 are preferably selectively removable from the rack to allow a practitioner to carry an entire tray (or multiple trays) and the contents to a fitting room or other remote location. Two flanges 92 are located on the top face of the back portion 97 of the tray 91, and abut against stop members of the tracks 82 to retain the tray within its stackable module and prevent the tray from inadvertently being completely removed when slid into the open position. FIG. 9 shows a top view of one embodiment of a drawer or tray 91, but it will be understood that trays having multiple differing product layouts will be provided. The tray 91 has at least one, and typically a plurality of receptacles or slots 93 for retaining a contact lens package or other item therein. The slots 93 can vary in dimension within a single tray 91 or alternatively all of the slots within a single tray are of a uniform dimension. In one aspect, the slots range from equal to or slightly larger than about 10-30 mm in a first dimension by about 50-160 mm in a second dimension, to receive boxes of contact lenses with a close running fit or a loose interference fit, but it will be understood that the invention includes slot configurations of greater or lesser dimensions. Particular slot dimensions can include, for example, about: 13 mm×50 mm; 13 mm×150 mm; 150 mm×50 mm; 30 mm×13 mm; 50 mm×30 mm; 40 mm×40 mm; 40 mm×85 mm; 13 mm×90 mm; and/or 50 mm×90 mm. Additionally or alternatively, multiple slot configurations can be nested within or overlapping one another, for example having one or more smaller slots with a lesser length and a lesser width formed into the floor and/or sidewalls of a larger slot with a greater length and a greater width.

The slots of a drawer or tray 91 optionally form an array of rows and/or columns. For example, a plurality of rows 94 extend side-to-side across the tray 91, and a plurality of columns 95 extend front-to-back along the tray, each row and each column comprising a plurality of individual product positions or slots 93. The individual product positions or slots 93, the rows 94, and/or the columns 95, are optionally labeled with indicia identifying a characteristic of the lens or other product intended to be positioned therein. Thus, the one or more slots 93, rows 94, columns 95, and/or module(s) 12 of the system 10 can be configured to define one or more optical contact lens dispensing matrix(es). The lens matrix may be configured based on a product characteristic, and optionally based on a plurality of product characteristics, for example: product type, brand, spherical correction or diopter, cylindrical correction and/or angle of astigmatism, size, color, and/or combinations thereof. For example, FIGS. 1 and 9 show optical lens matrices based on columns designating varying astigmatism angle, rows designating varying spherical corrections, drawer or tray designating varying cylindrical correction, and by module designating varying brands. Additionally or alternatively, the system can define one or more product matrices based on different ocular conditions to be treated, such as for example: astigmatism, myopia, presbyopia, hyperopia, etc., and/or various combinations thereof.

Figure 10:
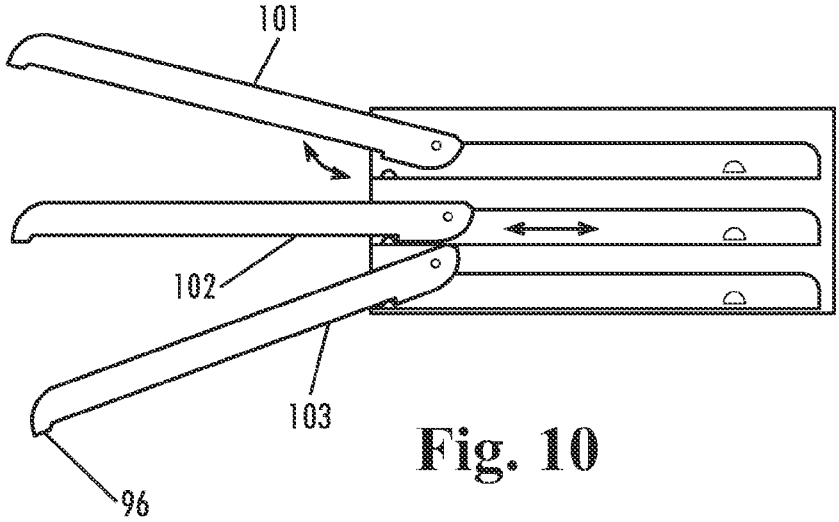
FIG. 10 is a side view showing trays in various positions within a stackable module, according to an example form of the invention.

As seen with reference to FIG. 10, the trays 91 are insertable into and removable from the tracks 82 of the stackable modules 12, and can be opened to display and dispense products contained therein. The front of tray 101 is angled upwardly, to allow the tray to be inserted and removed. In the horizontal position of the tray 102, the tray freely slides in and out, but stop members of the tray and the tracks prevent its removal. In the fully open position of the tray 103, the front of the tray can be angled or tilted downwardly, for example at an angle of about 15 degrees to about 45 degrees, and preferably about 30 degrees, for better display and dispensing of products therefrom. In the tray's closed position, the front of the tray optionally has an exposed lip or handle defining a display surface for branding indicia or product information.

Figure 11:
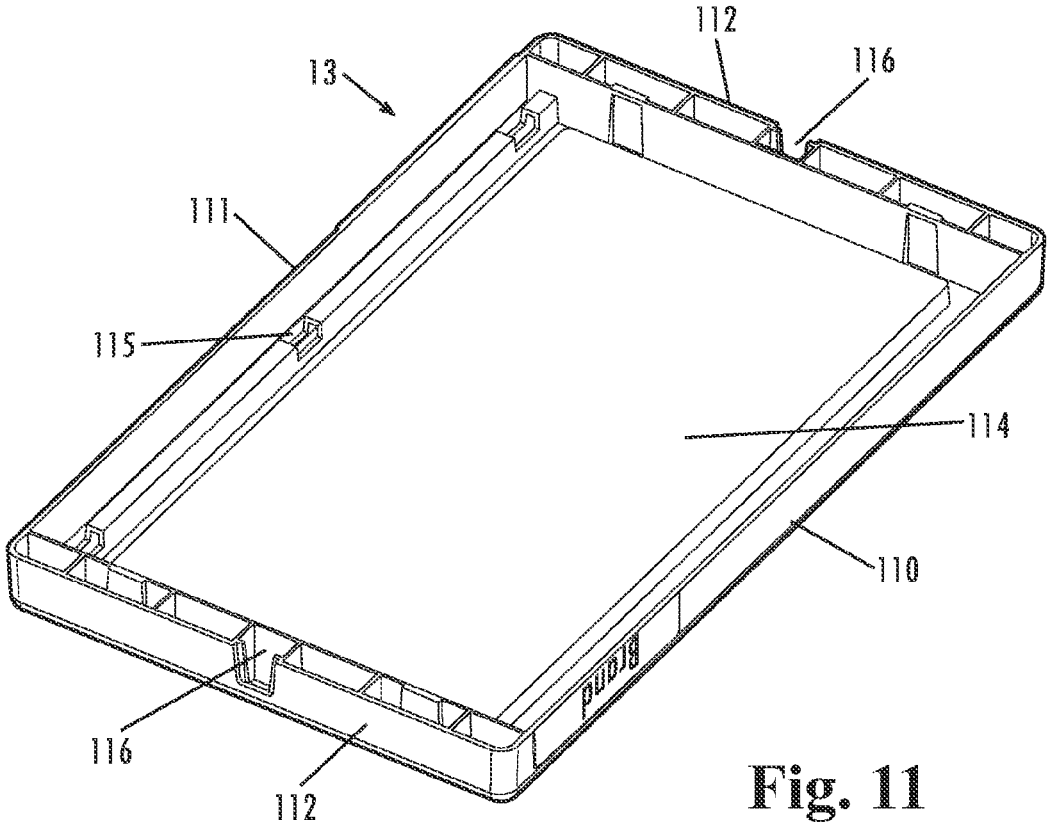
FIG. 11 is a perspective view of the interior face of the interlocking top of the rack system, according to an example form of the invention.
Figure 12:
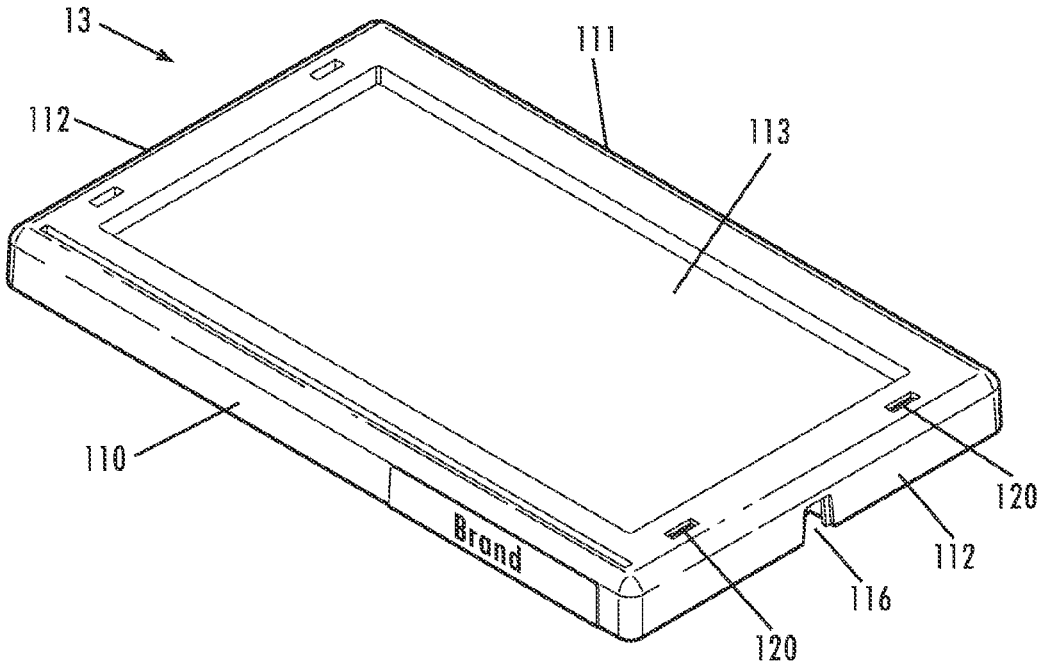
FIG. 12 is a perspective view of the exterior face of the interlocking top of FIG. 11.
Figure 13:
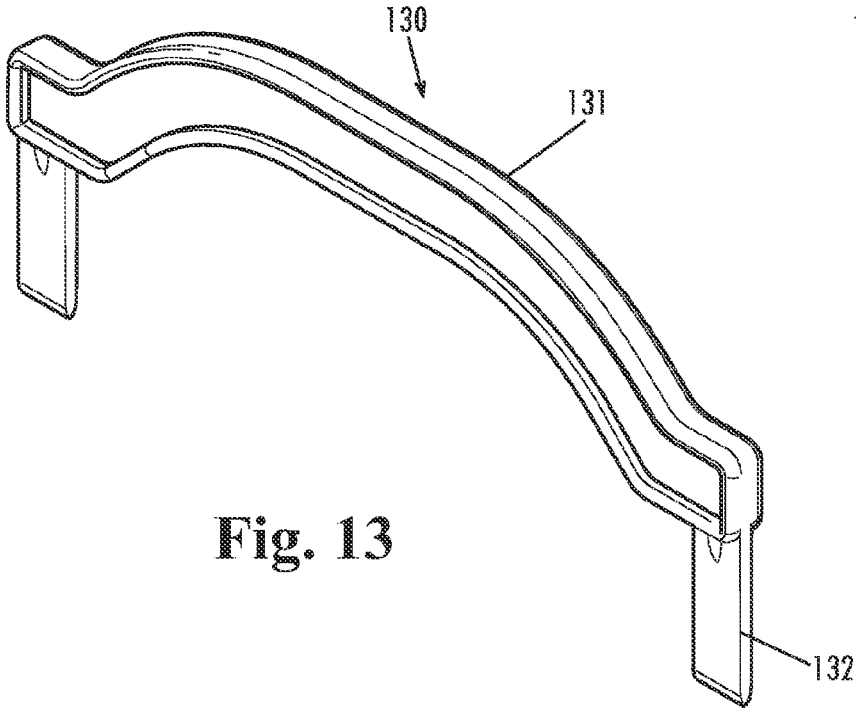
FIG. 13 is a perspective view of a disassembly tool for the modular rack system, according to an example form of the invention.
Figure 14:
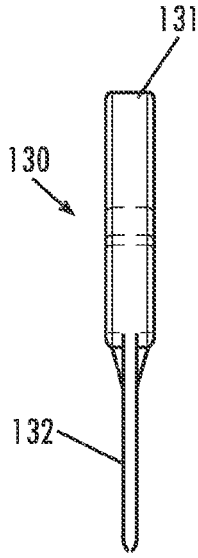
FIG. 14 is a side view of the disassembly tool of FIG. 13.

In the depicted embodiment, the racking system 10 further comprises an interlocking cap or top 13 (FIGS. 11, 12). The interlocking top 13 has a front 110, a back 111, sides 112, an exterior face 113, and an interior face 114. Formed into the interior face (FIG. 11) of the interlocking top are channels or ribs comprising one or more first female receiver couplings 115 that receive the stacking flange(s) 58 of the back panel, and one or more second female receiver couplings 116 that receive and releasably engage the male coupling fins 72 of the vertical side panels. A pair of openings 120 extends through the exterior face (FIG. 12) of the interlocking top on each side, in alignment with the second female receiver couplings, for disassembly using the tool 130.

The racking system 10 optionally comprises locking or other security features for enclosing and preventing unauthorized access to products stored therein. For example, one or more of the drawers 91 can be lockable, or a door or locking panel can be provided for placement over the drawers, having a keyed, combination, or other form of lock for enclosing and securing the system.

A disassembly tool 130 is optionally provided to disassemble the components of the racking system 10 from one another. The disassembly tool 130 comprises a handle portion 131 having a release finger 132 extending from each end thereof. The overall shape of the disassembly tool 130 is configured to match and be received in the chamber 21 of the base 11 or in a storage compartment elsewhere in the racking system. The spacing between the release fingers 132 is equal to the spacing between the pairs of openings 74, 120 in the side panel 41 and the top 13, respectively. Pushing the release fingers 132 into the openings 74, 120 releases the connection between the interlocking assembly elements of the components of the racking system, allowing the components to be readily disassembled and reconfigured without damage, and without the need for other tools.

While the invention has been described with reference to preferred and example embodiments, it will be understood by those skilled in the art that a variety of modifications, additions and deletions are within the scope of the invention, as defined by the following claims. For example, where the interlocking assembly elements are described herein by way of examples wherein component A includes a male assembly element and component B includes a cooperating female assembly element, it will be understood that the invention likewise includes the reverse configuration, wherein component A includes a female assembly element and component B includes a cooperating male assembly element.

What is claimed is:

1. A modular racking system for contact lenses, comprising:

a support base having a plurality of removable caster wheels for conversion between movable use with the caster wheels and stationary use without the caster wheels, and defining a tool-receiving chamber therein;

a plurality of stackable modules arranged in a vertical array, each stackable module defining a plurality of tracks for receiving vertically repositionable product trays therein, the vertically repositionable product trays sliding horizontally in and out of the stackable module, wherein the plurality of stackable modules comprises a lowermost stackable module that is releasably coupled to the support base and an uppermost stackable module above the lowermost stackable module;

wherein each of the stackable modules comprises a back panel, and left and right side panels releasably coupled to the back panel;

wherein the vertically repositionable product trays define product positions arranged in a plurality of rows and a plurality of columns, and wherein the rows are labeled with first indicia designating a first contact lens characteristic, and the columns are labeled with second indicia designating a second contact lens characteristic;

a cap releasably coupled to the uppermost stackable module; and a disassembly tool receivable within the tool-receiving chamber for releasing the coupling between the back panel and the side panels, and for releasing the coupling between the cap and the uppermost stackable module, the disassembly tool comprising a handle and a spaced pair of release fingers.

2. The modular racking system of claim 1, wherein the first contact lens characteristic and the second contact lens characteristic are selected from: product type, brand, spherical correction, cylindrical correction, angle of astigmatism, size, color, and ocular condition to be treated; and wherein the first indicia and the a second indicia are selected from: module position within a system, tray position within a module, row position within a product array, and column position within a product array.

3. The modular racking system of claim 1, wherein the vertically repositionable product trays can be tilted angularly in an open position.

4. The modular racking system of claim 1, wherein the vertically repositionable product trays can be tilted angularly downward at about 15 degrees to about 45 degrees from horizontal in an open position.

5. The modular racking system of claim 1, wherein the at least one tray can be tilted angularly downward at least about 30 degrees from horizontal in an open position.

6. The modular racking system of claim 1, wherein the chamber and the disassembly tool have closely matching shapes.

7. The modular racking system of claim 1, further comprising a differing third contact lens characteristic for each of the vertically repositionable product trays.

8. The modular racking system of claim 7, further comprising a differing fourth contact lens characteristic for each of the plurality of stackable modules.

9. The modular racking system of claim 1, wherein a third contact lens characteristic is designated by each vertically repositionable product tray, and a fourth contact lens characteristic is designated by each stackable module.

10. The modular racking system of claim 9, wherein the vertically repositionable product trays can be tilted angularly in an open position.

11. The modular racking system of claim 9, wherein the vertically repositionable product trays can be tilted angularly downward at about 15 degrees to about 45 degrees from horizontal in an open position.

12. The modular racking system of claim 9, wherein the at least one tray can be tilted angularly downward at least about 30 degrees from horizontal in an open position.

13. The modular racking system of claim 9, wherein the chamber and the disassembly tool have closely matching shapes.

* * * * *